US005230296A

United States Patent [19]

Giltz et al.

[11] Patent Number: 5,230,296

[45] Date of Patent: Jul. 27, 1993

[54] RETRACTABLE PARKING AID

[76] Inventors: Ann M. Giltz; Perry M. Giltz, both of 64 Racing Wind, Irvine, Calif. 92714

[21] Appl. No.: 845,315

[22] Filed: Mar. 3, 1992

[51] Int. Cl.[5] ..... G09F 7/20

[52] U.S. Cl. ..... 116/28 R; 33/264; 40/603

[58] Field of Search ..... 116/28 R; 40/592, 603; 33/264

[56] References Cited

U.S. PATENT DOCUMENTS 2,854,942 10/1958 Ross ..... 116/28 R
2,854,942 10/1958 Ross ..... 116/28
3,993,981 2/1974 Sparks ..... 116/28 R
4,158,925 6/1979 Gagnon ..... 40/591
4,895,097 1/1990 Lechnit ..... 116/28 R

*Primary Examiner*—Daniel M. Yasich
*Attorney, Agent, or Firm*—Dennis W. Beech

[57] ABSTRACT

An improved parking aid device for positioning a moving vehicle in a specific parking space of limited size the device is suspended from overhead support and comprises in combination a retractable corrugated tube with an illuminated pendant connecting at lower end extending downwardly to a level within driver's view at vehicle windshield which makes contact with pendant staying at rest until vehicle advances past desired location and pendant shows angled position.

3 Claims, 2 Drawing Sheets

RETRACTABLE PARKING AID

BACKGROUND

1. Field of Invention

This invention relates to a retractable device used as a visual guide to position a moving vehicle in a specific parking space, providing retractable adjustment, safety and convenient storage of device.

2. Description of Prior Art

Garage space in many residences can be quite limiting as they are used not only for parking but as utility and storage space. The driver has minimal space to center and stop. Judging car bumper to wall and side wall distance can be difficult. Many people need walking and working space to be the most effective on a daily basis. Vehicle damage can occur when bumpers hit garage walls or other objects. Rear view is extremely difficult and damage can also result when vehicles are positioned too far back in parking space and the garage door hits vehicle upon closing.

U.S. Pat. No. 3,793,981 to Sparks (1974) discloses a suspending weighted plumb line with a second line having a "brusher" to position vehicle. However, these lines which hand separately can tangle and twirl into one. Whereas stated, plumb lines need to be separated to show how far brusher moves with regard to position of plumb line with weight. There is also a question as to the safety of a freely suspended weight with a pointed edge in an accessible location. Further disadvantages are as follows:

a. length of plumb lines has to be predetermined;
b. storage of product is difficult unless removing device completely;
c. preferable location is at center strip of hood, while many vehicles today do not have this feature;
d. installation and adjustability.

OBJECT OF THE INVENTION

Accordingly, several objects and advantages of my invention are as follows:

a. desired suspended location shall be at the windshield for easy visibility any time of day;
b. retractable feature allows for accessibility, adaptability, installation, also allows to be retracted completely when not in use;
c. polypropylene corrugated tubing is strong and economical;
d. corrugation allows over 8 feet in length when completely stretched;
e. suspended, fluorescent pendant allows easy viewing and proper vehicle placement;
f. mount holes on each end;
g. shank, (non-corrugated tubing) ends, allow space for new holes to be hand punched in by the consumer should either end rip accidentally;
h. preferable location of device is in view of the windshield, thereby keeping out of reach of children and resulting in greater safety;
i. tube will be approximately ¼" to ½" in diameter, resulting in a pleasing look with no bulkiness;
j. pendant is to be made of a smooth, lightweight plastic, mount hole with angle cut for corrugated tube to be inserted.
k. pendant will be connected and swing freely in tube hole allotment, which allows movement to take place when car makes contact, thus allowing driver to make easy parking placement when car just barely touches pendant and continues to hang vertically.
l. pendant will show a fluorescent arrow pointing downwardly or other fluorescent design. The pendant will be of a preferable black color to allow for illuminating design to show to its fullest effect as a visual guide.

In accordance with the description presented herein, other objectives of this invention will become apparent when the description and drawings are reviewed.

DESCRIPTION OF THE PREFERRED EMBODIMENT

Figure 1:
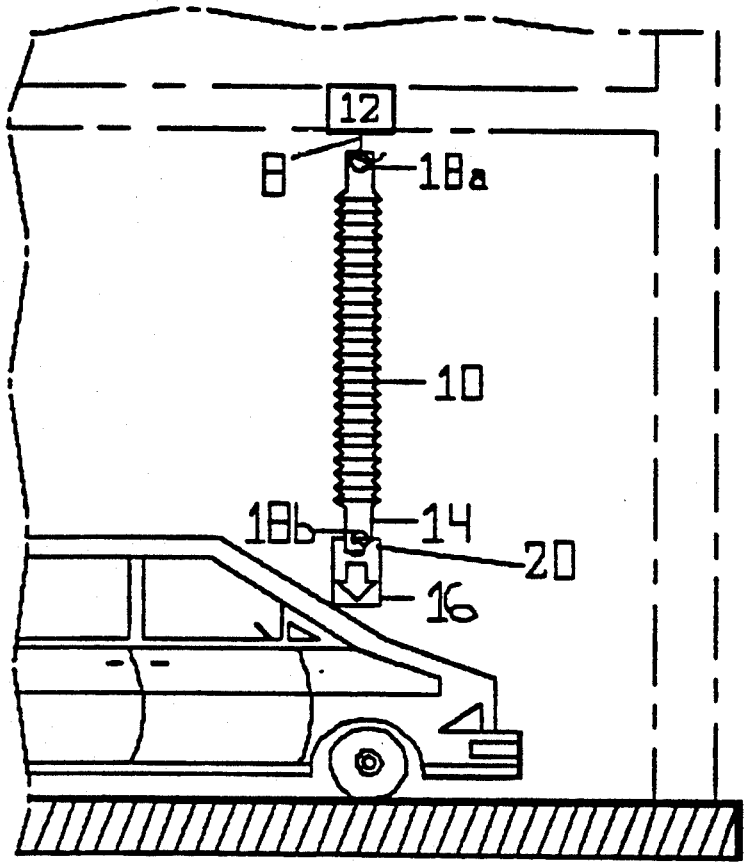
FIG. 1, is an enlarged side elevational view of the device with a vehicle positioned in place, the windshield of the vehicle being engaged with the pendant.
Figure 3:
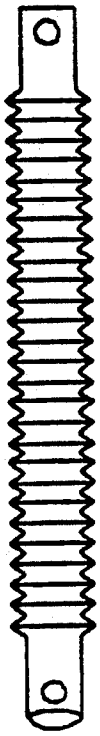
FIG. 3, is an enlarged view showing complete corrugated tube and mount holes.

A typical embodiment of the device of the present invention is illustrated in FIG. 1. In the preferred embodiment, the corrugated tube 10, FIG. 3, is a lightweight, flexible plastic such as polypropylene, extending downwardly from a position 8 on an overhead support 12. The length of the corrugated tube shall be 4 feet in its retracted position, with its length at least doubled when stretched in operation. The flexible plastic and corrugated feature allows the corrugated tube (10) to be adjusted in length by applying either a pushing or pulling force at the two shank ends (14). The plastic material and the corrugation feature remain at the length in which the force places the corrugated tube (10). This feature is essentially a memory device as to the position stretched or compressed rather than a spring action with stored energy when compressed or stretched. FIG. 3 shows both ends shall have 1" shank 14 and contain a single mount hole 18*a*, and 18*b*, which is punched completely through the shank, having approximately ⅜" diameter.

Figure 4:
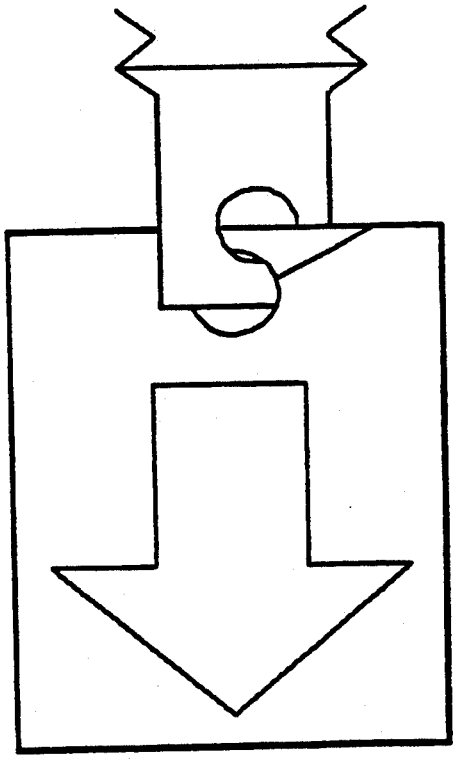
FIG. 4, is an enlarged view showing corrugated tube and pendant connection.

The pendant 16, as shown in FIG. 4 in its preferred embodiment, a rectangular shape, shall be made of a lightweight, somewhat flexible plastic such as polypropylene, polyethylene, vinyl, nylon, rubber, various plasticisized materials, cardboard, paper, etc. There are various possibilities with regard to the shape of the pendant such as square, circular, octagonal, etc. The pendant it typically 1 mm to 2 mm in thickness and has overall dimensions roughly from 1½"×2½" (rectangular shape). FIG. 4 shows a pendant mount hole 20, centered at top of pendant is approximately ⅜" diameter. Angled cut which extends from right side of mount hole through top edge of pendant may vary in length. However, cut can be angled to either side of mount hole.

Figure 2:
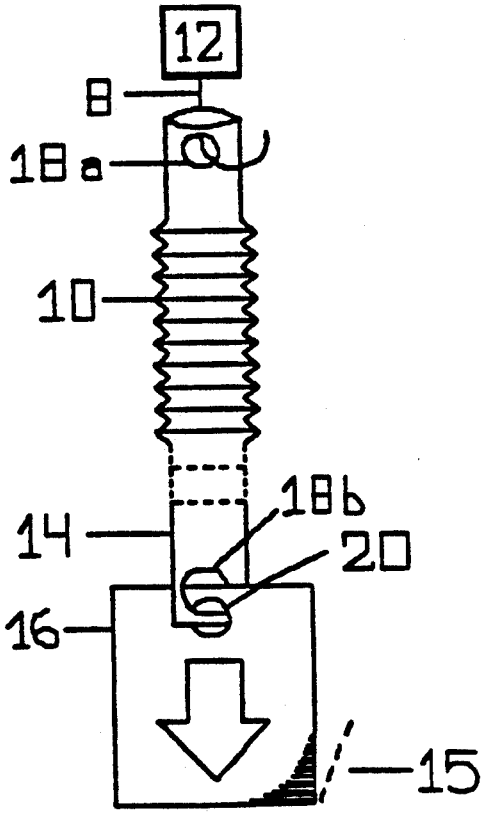
FIG. 2, is an enlarged side elevational view of the device with the corrugated tubing and pendant at rest, tubing in partially stretched position, and showing possible forward and angled movement.

There are various possibilities with regard to design on pendant as FIGS. 1, 2, and 4 show downwardly pointed arrow. Designs may consist of printing or decal, but shall consist of one or combination of fluorescent colors. Additionally, the placement of a logo and or trademark may be present.

The manner of using the retractable parking aid consists of the following procedure;

Using mount hole 18*a*, FIGS. 1, 2; corrugated tube 10, FIG. 3, is to be suspended from overhead support 12. Placed and suspended in desired parking location for driver to view corrugated tube with pendant 16, FIGS. 1, 2. The lower end of parking device being viewed in preferred windshield location, FIG. 1, by driver. The pendant will move in a forward motion, and show angled position 15, FIG. 2, when vehicle has moved past the desired parking location. The retractable feature allows driver or other person to adjust length of device by simply pushing up or pulling down gently with hands. The pendant to corrugated tube connection requires the mount hole 18*b* of tube to be manually squeezed and slid through mount hole with angle cut 20 of pendant 16, whereby pendant 16 will end up in a freely swinging connection, FIGS. 1, 2, and 4.

Accordingly, the reader will see the retractable corrugated tube and pendant of the invention can be used to position vehicle easily. Provides convenience, adjustability and storage of device. Additionally, the device is safe, lightweight, yet economical and can be used by any driver of almost any vehicle. Further advantages are as follows:

provides an a pendant with luminescent material which with any light source causes an illuminated point of referance for parking;

device stays out of reach of children, and adults when working in area;

length of product does not have to be predetermined; sufficient length in retractable corrugated tube for installation in parking structures of greater height;

Mount holes can be re-punched in ends, in the event either end should rip accidentally.

Although the description above contains many specificities, these should not be construed as limiting the scope of the invention, but merely providing illustration of some of the presently preferred embodiments of this invention. For example, the pendant may be of various shapes, sizes, colors and designs. Furthermore, the corrugated tubing may be of one of several colors and possible designs. Finally, the scope of the invention should be determined not by the embodiment illustrated, but by the appended claims and their legal equivalents.

We claim:

1. An adjustable device for determining the specific position of a moving vehicle for the driver's purpose of parking the vehicle in a space of limited size, comprising:

a. a corrugated tube of adjustable plastic fastened at a shank to a support at a predetermined position;

b. a pendant with a fluorescent marking attached at a shank such that the pendant can move relative to the corrugated tube.

2. The device of claim 1 wherein said adjustable plastic corrugated tube has a mount hole in the shank end.

3. The device of claim 1 wherein said pendant has a pendent mount hole with a slot made at an angle relative to the vertical axis of the pendant.

* * * * *